United States Patent [19]

Stein et al.

[11] Patent Number: 4,894,017

[45] Date of Patent: Jan. 16, 1990

[54] ELECTRICAL HEADER ASSEMBLY

[75] Inventors: William L. Stein; Randy L. Fink, both of Warren; Bruce J. Serbin, Austintown, all of Ohio

[73] Assignee: General Motors Corporation, Detroit, Mich.

[21] Appl. No.: 296,568

[22] Filed: Jan. 13, 1989

[51] Int. Cl.[4] ..... H01R 9/09

[52] U.S. Cl. ..... 439/78; 439/79; 439/595

[58] Field of Search ..... 439/76, 78, 79, 80, 439/83, 595, 660, 676

[56] References Cited

U.S. PATENT DOCUMENTS

| | | | |
|---|---|---|---|
| 3,493,916 | 2/1970 | Hansen | 439/79 |
| 3,616,534 | 11/1971 | Black | 29/845 |
| 4,186,988 | 2/1980 | Kobler | 439/676 |
| 4,210,376 | 7/1980 | Hughes et al. | 439/676 |
| 4,486,059 | 12/1984 | DeYoung | 439/660 |
| 4,491,376 | 1/1985 | Gladd et al. | 439/79 |
| 4,618,207 | 10/1986 | Silbernagel | 439/676 |
| 4,722,691 | 2/1988 | Gladd et al. | 439/79 |
| 4,738,638 | 4/1988 | Bogese, II | 439/78 |

*Primary Examiner*—William Briggs
*Attorney, Agent, or Firm*—F. J. Fodale

[57] ABSTRACT

An electrical header assembly for a printed circuit board or the like comprises a housing of thermoplastic material having a mating portion and a conductor portion and a row of laterally spaced insert molded blade terminals of stamped sheet metal construction. The blade terminals have tails which are bent vertically in a secondary bending operation to provide vertical legs which are positioned and retained by laterally deflectable walls defining channels at the end of the conductor portion of the housing. The housing has a narrow peripheral groove which is defined by confronting faces of the mating and conductor portions of the housing and which is adapted for mounting the electrical header connector on an apertured panel wall.

10 Claims, 3 Drawing Sheets

ELECTRICAL HEADER ASSEMBLY

BACKGROUND OF THE INVENTION

This invention relates generally to electrical connectors and more specifically to electrical header assemblies which are attached to printed circuit boards or the like.

Electrical header assemblies having terminals which are inserted into a housing with protruding tails which are bent in a secondary bending operation for attachment to a printed circuit board are already known. See, for instance, U.S. Pat. No. 3,493,916 granted to Wallace Hansen Feb. 3, 1970; U.S. Pat. No. 4,186,988 granted to Robert W. Kobler Feb. 5, 1980; U.S. Pat. No. 4,210,376 granted to Donald W. K. Hughes and Ronald W. Myers July 1, 1980 and U.S. Pat. No. 4,491,376 granted to Joseph H. Gladd, Robert G. Plyler and Lyle B Suverison Jan. 1, 1985.

SUMMARY OF THE INVENTION

The object of this invention is to provide an improved electrical header assembly of the above noted type.

A feature of the invention is that electrical header assembly has an improved means for positioning and retaining vertical legs of the protruding tails of the terminals which are bent in a secondary bending operation.

Another feature of the invention is that the electrical header assembly has means for positioning and retaining the bent tails of the terminals which is especially suitable for use with terminals of sheet metal construction having bent tails with flat vertical legs.

Another feature of the invention is that the flat vertical legs has coplanar laterally extending retention tabs which facilitate molding the positioning and retaining means of the housing.

Another feature of the invention is that terminals have bent tails which provide relatively flexible vertical legs which are positioned and retained in a manner which permits the free ends of the vertical legs to adjust and accommodate manufacturing variations in the printed circuit board on which the electrical header assembly is mounted.

Another feature of the invention is that the vertical legs of the terminal are disposed and retained in channels for protection against physical damage during handling and for electrical isolation from each other during use.

Another feature of the invention is that vertical legs of the terminals are held away from the main body of the housing allowing ample space for venting or potting.

Another feature of the invention is that the electrical header assembly is especially suitable for insert molded blade terminals of stamped sheet metal construction.

Another feature of the invention is that the electrical header assembly is configured so that the mating electrical connector is plugged perpendicularly to the printed circuit board so as to conserve space while the terminals themselves are configured to provide relatively flexible vertical legs which accommodate manufacturing variations in the printed circuit board.

Yet another feature of the invention is that the housing has a peripheral slot for mounting the electrical header assembly on a slotted metal panel.

Still yet another feature of the invention is that the peripheral mounting slot may be configured for sealing engagement with a slotted mounting panel incorporated into the side of a protective case to facilitate retention of a liquid potting compound within the protective case.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
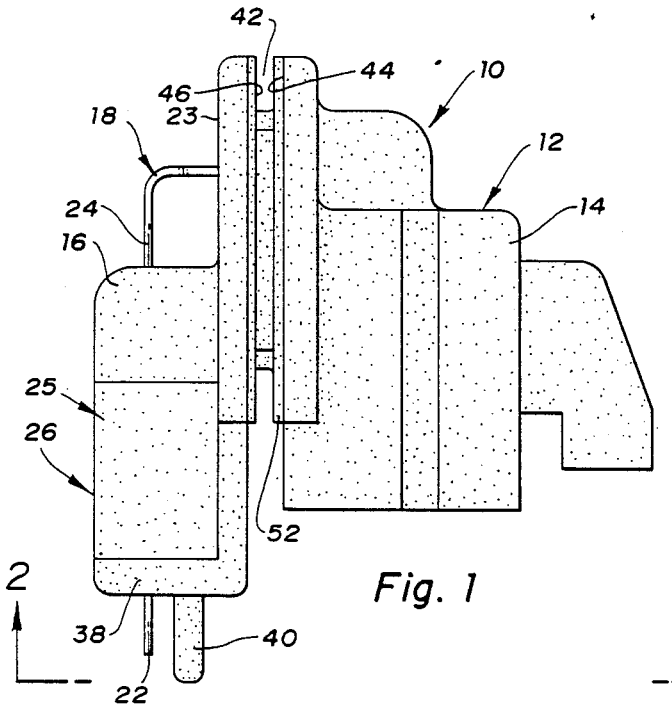
FIG. 1 is side view of an electrical header assembly in accordance with this invention.
Figure 2:
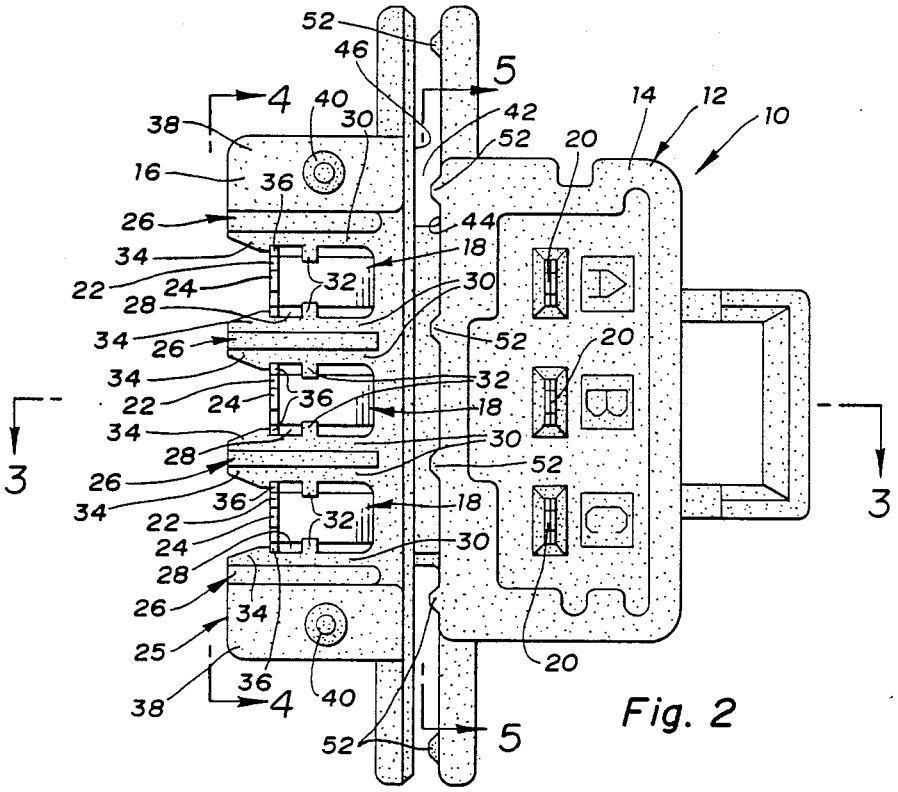
FIG. 2 is a bottom view of the electrical header assembly taken substantially along the line 2—2 of FIG. 1 looking in the direction of the arrows.

Referring now to the drawing an electrical header assembly 10 for a printed circuit board or the like comprises a housing 12 of thermoplastic material which has a mating portion 14 and a conductor portion 16. A row of laterally spaced blade terminals 18 of stamped sheet metal construction are insert molded into the housing 12.

The mating ends of the blade terminals 18 are a double layered construction to increase the thickness and rigidity of the exposed contact tips 20 which project into a socket of the mating portion 14 of the housing 12 for connection to a mating electrical connector (not shown). The conductor ends of the blade terminals 18 have flat tails 22 of single layer construction. The flat tails 22 originally project longitudinally from the end 23 of the conductor portion 16 housing when the blade terminals 18 are insert molded in the housing 12 as shown in dashed lines in FIG. 3.

Figure 3:
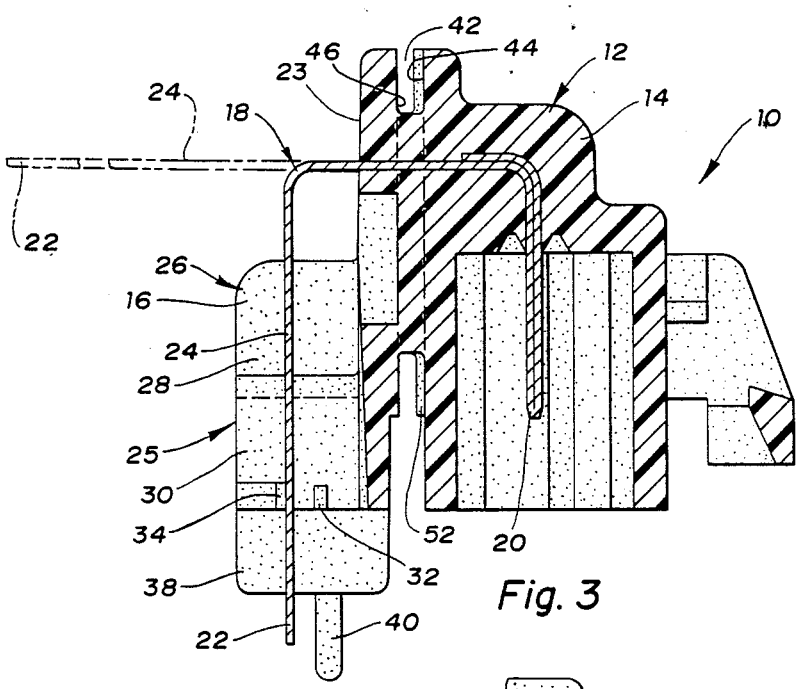
FIG. 3 is a section view of the electrical header assembly taken substantially along the line 3—3 of FIG. 2 looking in the direction of the arrows.

The flat tails 22 of the insert molded blade terminals 18 are then bent vertically at a location spaced from the end 23 of the conductor portion in a secondary bending operation so that the blade terminals 18 are U-shaped as shown in solid lines in FIG. 3. This provides relatively flexible vertical legs 24 for connecting the blade terminals 18 electrically to contacts on a printed circuit board or the like which are conventionally apertured to receive the free ends of the vertical legs 24.

Figure 4:
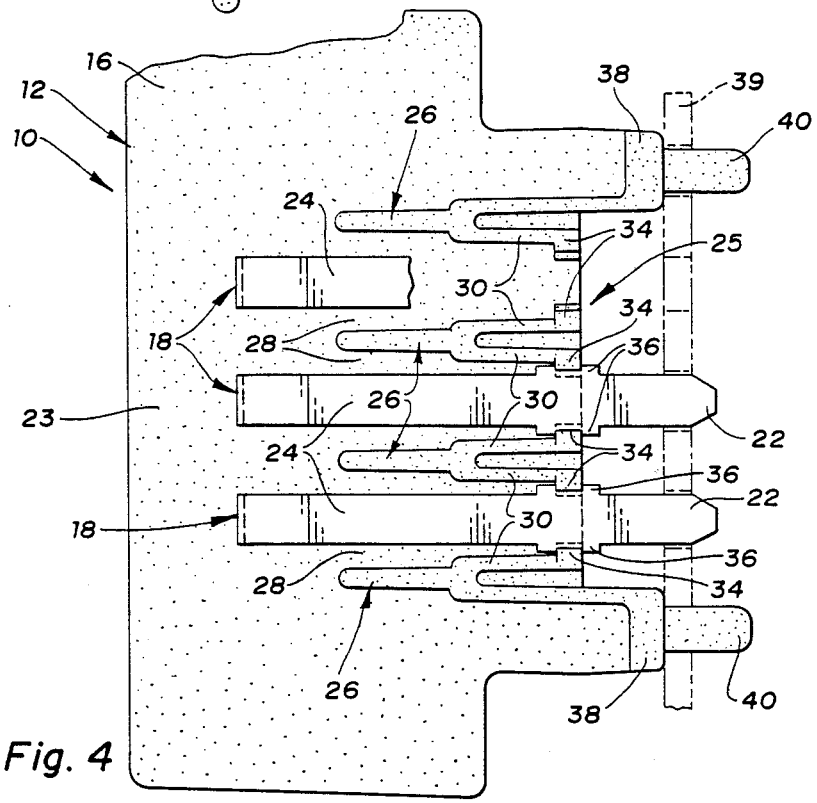
FIG. 4 is a section view of the electrical header assembly taken substantially along the line 4—4 of FIG. 2 looking in the direction of the arrows.
Figure 5:
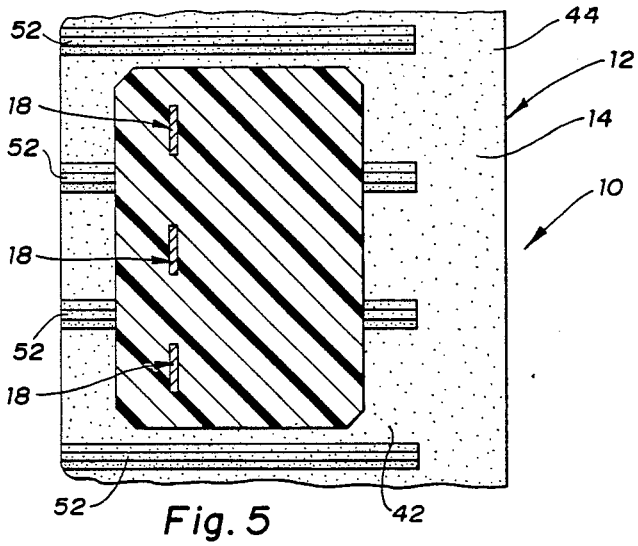
FIG. 5 is a section view of the electrical header assembly taken substantially along the line 5—5 of FIG. 2 looking in the direction of the arrows.

The housing 12 has means, indicated generally at 25, for positioning the vertical legs 24 of the tails 22 which are bent in the secondary bending operation so as to facilitate insertion of the free ends of the vertical legs 24 into the apertures associated with the contacts of the printed circuit board. The positioning means 25 comprise a plurality of vertical partitions 26 at the end 23 of the conductor portion 16 of the housing 12. These partitions 26 provide a plurality of vertical channels 28 which receive the vertical legs 24 of the respective blade terminals 18 as best shown in FIG. 4.

The vertical partitions 26 have bifurcated lower portions which form separate laterally deflectable lock walls 30 on each side of each of the vertical channels 28. The laterally deflectable lock walls 30 have medial stop nibs 32 which limit movement of the vertical legs 24 toward the end 23 of the conductor portion 16 and latch ramps 34 at their lower outboard corners which retain the vertical legs 24 in the longitudinal direction away from the end 23.

The vertical legs 24 of the blade terminals 18 are flat and have coplanar laterally projecting retention tabs 36. These retention tabs 36 snap past the latch ramps 34 during the secondary bending operation and then cooperate with the medial stop nibs 32 and the latch ramps 34 to position and retain the vertical legs in the vertical channels 28. More specifically the stop nibs 32 limit the movement of the vertical legs in the direction toward the end 23 of the housing 12 while the latch ramps 34 limit the movement away from the end 23 in the longitudinal direction.

Thus the relatively flexible vertical legs 24 are free to move in the longitudinal direction of the housing 12 within the limits established by the stop nibs 32 and the latch ramps 34. Consequently, the positioning means 25 not only locates the vertical legs 24 accurately for electrical connection to the printed circuit board but also allows adjustment of the free ends of the vertical legs 24 to accommodate manufacturing variations in the locations of the apertures associated with the mating contacts on the printed circuit board.

The laterally projecting retention tabs 36 permit the molding of the stop nibs 32 and the latch ramps 34 without the use of side cores.

Figure 6:
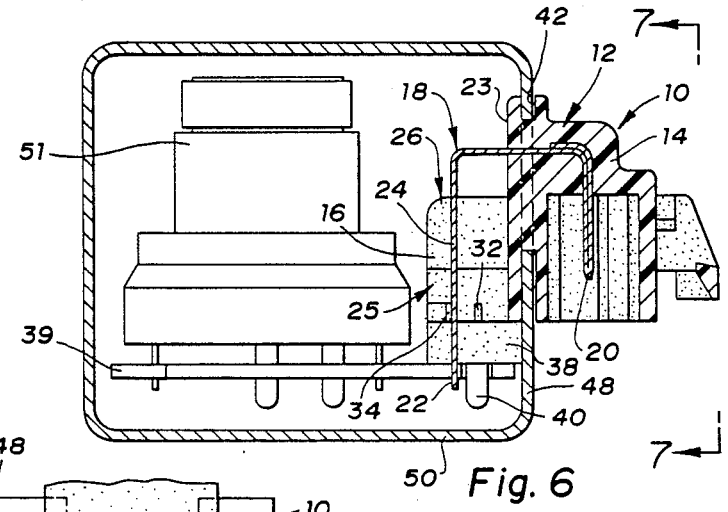
FIG. 6 is a partially sectioned side view of an encased assembly which includes the electrical header assembly shown in FIGS. 1–5.

The positioning means 25 further includes support feet 38 with depending locator pins 40 for locating and mounting the housing 12 on the printed circuit board 39 as shown in FIG. 6. When so mounted, the socket of the mating portion 14 faces downwardly so that the mating electrical connector (not shown) is plugged perpendicularly to the printed circuit board 39. This conserves space in the lateral direction.

The support feet 38 are spaced below the bottom of the rest of the housing 12 as best shown in FIG. 4. This raises the housing 12 off the printed circuit board to facilitate use of a conventional solder flow technique for soldering the vertical legs 24 of the blade terminals 18 to the apertured contacts of the printed circuit board.

Figure 7:
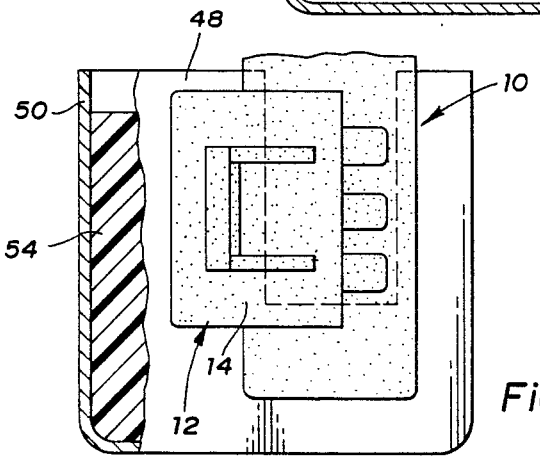
FIG. 7 is a section view of the encased assembly of FIG. 6 after potting and taken substantially along the line 7—7 of FIG. 6 looking in the direction of the arrows.

The housing 12 of the electrical header connector 10 has a narrow peripheral groove 42 which is defined by confronting faces 44 and 46 of the respective mating and conductor portions 14 and 16 of the housing 12. The narrow peripheral groove 42 is sized for mounting the electrical header connector 10 on a slotted panel wall, such as the side wall 48 of a protective metal casing 50 which is shown in FIGS. 6 and 7. The housing 12 is mounted on the side wall 48 simply by sliding the edges of the casing 50 adjacent the slot into the peripheral groove 42.

In some instances it may be desirable to hermetically seal the electrical connections of the electrical header assembly 10 and the electrical connections of other electrical components, such as, the sensor assembly 51, to the printed circuit board. To this end the confronting face 44 of the mating portion 14 has a plurality of vertical ribs 52 which bias the confronting face 46 of the inside surface of the conductor portion 16 into sealing engagement with the side wall 48 so that the casing 50 can be filled with a liquid potting compound 54 without leaking as shown in FIG. 7.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical header assembly for a printed circuit board or the like comprising:

a housing of thermoplastic material having a mating portion and a conductor portion, a row of laterally spaced blade terminals of stamped sheet metal construction disposed in said mating portion and said conductor portion, said blade terminals having tails which project longitudinally from an end of the conductor portion of the housing and which are bent vertically at a location spaced from the end of the conductor portion to provide vertical legs, and means to position the vertical legs of the blade terminals for attachment to conductors of a printed circuit board or the like, said means including:

a plurality of vertical partitions at the said end of the conductor portion of the housing which form a plurality of vertical channels which receive vertical legs of the respective terminals, said partitions having lower portions which form laterally deflectable lock walls on each side of each of the vertical channels, said laterally deflectable lock walls having stop nibs which limit the movement of the vertical legs toward the said end of the conductor portion and latch ramps which retain the vertical legs in the longitudinal direction away from the said end of the conductor portion.

2. The electrical header assembly as defined in claim 1 wherein the blade terminals are insert molded into the thermoplastic housing.

3. The electrical header connector as defined in claim 2 wherein the mating portion of the housing is configured to receive a mating electrical connector perpendicularly to the printed circuit board and wherein the blade terminals are U-shaped and have exposed tips in the mating portion of the housing.

4. The electrical header connector as defined in claim 1 wherein the vertical legs in the tails of the blade terminals are flat and have coplanar laterally projecting retention tabs which cooperate with the stop nibs and the latch ramps of the lock walls to position and retain the vertical legs in the vertical channels.

5. The electrical header connector as defined in claim 1 wherein the housing has a narrow peripheral groove which is defined by confronting faces of the mating and conductor portions of the housing and which is adapted for mounting the electrical header connector on an apertured panel wall.

6. The electrical connector as defined in claim 5 wherein one of the confronting faces has a plurality of vertical ribs for biasing the other of the confronting faces into sealing engagement with the panel wall on which the electrical header connector is mounted.

7. An electrical header assembly for a printed circuit board or the like comprising:

a housing of thermoplastic material having a mating portion and a conductor portion, a row of laterally spaced blade terminals of stamped sheet metal construction which are insert molded into said housing, the blade terminals being U-shaped and having exposed tips in the mating portion of the housing, the blade terminals having tails which project longitudially from an end of the conductor portion of the housing and which are bent vertically at a location spaced from the end of the conductor portion to provide vertical legs, and means to position the vertical legs of the blade terminals for attachment to conductors of a printed circuit board or the like, said means including:

a plurality of vertical partitions at the end of the conductor portion of the housing which form a plurality of vertical channels which receive respective vertical legs of the respective blade terminals, said partitions having bifurcated lower portions which form laterally deflectable lock walls on each side of each of the vertical channels, said laterally deflectable lock walls having medial stop nibs which limit movement of the vertical legs toward the said end of the conductor portion and latch ramps at their lower outboard corners which retain the vertical legs in the longitudinal direction away from the said end of the conductor portion.

8. The electrical header connector as defined in claim 7 wherein the vertical legs of the blade terminals are flat and have coplanar laterally projecting retention tabs which cooperate with the medial stop nibs and the latch ramps of the partitions to position and retain the vertical legs in the vertical channels.

9. The electrical header connector as defined in claim 7 wherein the housing has a narrow peripheral groove which is defined by confronting faces of the mating and conductor portions of the housing and which is adapted for mounting the electrical header connector on an apertured panel wall.

10. The electrical connector as defined in claim 9 wherein one of the confronting face of the mating portion has a plurality of vertical ribs for biasing the confronting face of the conductor portion into sealing engagement with the panel wall on which the electrical header connector is mounted.

* * * * *